US007365717B2

(12) United States Patent
Lee et al.

(10) Patent No.: US 7,365,717 B2
(45) Date of Patent: Apr. 29, 2008

(54) ORGANIC LIGHT EMITTING DISPLAY AND METHOD FOR DRIVING THE SAME

(75) Inventors: Myung Ho Lee, Euiwang-si (KR); In Hwan Kim, Seoul (KR)

(73) Assignee: LG.Philips LCD Co., Ltd., Seoul (KR)

( * ) Notice: Subject to any disclaimer, the term of this patent is extended or adjusted under 35 U.S.C. 154(b) by 84 days.

(21) Appl. No.: 11/117,709

(22) Filed: Apr. 29, 2005

(65) Prior Publication Data

US 2006/0061291 A1 Mar. 23, 2006

(30) Foreign Application Priority Data

Sep. 23, 2004 (KR) ..... 10-2004-0076195

(51) Int. Cl.
*G09G 3/30* (2006.01)

(52) U.S. Cl. ..... 345/77; 345/98; 345/99; 345/100; 345/84

(58) Field of Classification Search ..... 345/77, 345/98, 99, 100, 84, 212, 213, 214
See application file for complete search history.

(56) References Cited

U.S. PATENT DOCUMENTS

2005/0237002 A1* 10/2005 Nakamura ..... 315/169.3
2006/0007202 A1* 1/2006 Satoh et al. ..... 345/204
2006/0114215 A1* 6/2006 Lee et al. ..... 345/98

* cited by examiner

*Primary Examiner*—Tuyet Vo
(74) *Attorney, Agent, or Firm*—McKenna Long & Aldridge, LLP

(57) ABSTRACT

An apparatus and method for driving an organic light emitting display so as to minimize or prevent a raindrop phenomenon and an afterimage is provided. The apparatus and method determines the driving state of a pixel unit by using a vertical sync signal, and turns on or off the determined driving state of the pixel unit. The supply of the power voltage is sustained when the pixel unit is driven, and is turned off when the pixel unit is not driven. Accordingly, the apparatus and method can minimize or prevent a raindrop phenomenon and an afterimage by turning off the supply of the power voltage when the pixel unit is not driven.

17 Claims, 6 Drawing Sheets

ORGANIC LIGHT EMITTING DISPLAY AND METHOD FOR DRIVING THE SAME

This application claims the benefit of Korean Patent Application No. 2004-76195, filed on Sep. 23, 2004, which is hereby incorporated by reference for all purposes as if fully set forth herein.

BACKGROUND OF THE INVENTION

1. Field of the Invention

The present invention relates to an organic light emitting display, and more particularly, to an apparatus and method for driving an organic light emitting display, which can minimize or prevent a raindrop phenomenon and an after-image.

2. Discussion of the Related Art

An organic light emitting display is a self-luminous display that emits light by electrically exciting a fluorescent organic compound, and displays an image by driving N×M organic light emitting diodes (OLEDs).

There are two driving methods for the organic light emitting display, that is, a passive matrix (PM) method and an active matrix (AM) method. In the case of the PM method, anode electrodes and cathode electrodes are formed perpendicular to one another and the display is driven by selecting lines. In the case of the AM method, transistors and capacitors are connected to pixel electrodes formed of indium tin oxide (ITO) and the display is driven by maintaining voltages at the pixel electrodes using the capacitors.

FIG. 1 is a block diagram of a related art organic light emitting display. Referring to FIG. 1, the related art organic light emitting display includes a timing controller 10 for generating control signals, a scan driver 11 for sequentially supplying a scan signal "Vs" in response to a control signal generated from the timing controller 10, a data driver 12 for supplying a data signal "Vdata" in response to a control signal generated from the timing controller 10, a power supply 13 for supplying a power voltage "VDD", and a pixel unit 14 for driving an OLED according to the scan signal Vs and the data signal Vdata. The pixel unit 14 further includes a plurality of pixels 15 arranged in a matrix pattern.

FIG. 2 is a circuit diagram of a pixel shown in FIG. 1. Referring to FIG. 2, a pixel 15 includes a first transistor M1 connected to a data line 17 to be turned on by the scan signal Vs, a second transistor M2 connected to the first transistor M1 to be turned on by the data signal Vdata, a capacitor C connected to the first transistor M1 to maintain the data signal Vdata during a predetermined period (for example, one frame), and an OLED connected between the second transistor M2 and a power supply line 18 to emit light by a driving current of the second transistor M2.

When the first transistor M1 is turned on by the scan signal Vs, the data signal Vdata is charged in the capacitor C. Also, when the second transistor M2 is turned on by the data signal Vdata, the OLED emits light by the driving current of the second transistor M2. The OLED emits light by a given driving current, wherein the strength of the given driving current is proportional to the strength of the data signal Vdata. That is, when a data signal Vdata applied to the second transistor M2 becomes larger, the strength (that is, luminance) of light emitted from the OLED becomes larger because the driving current becomes larger. On the contrary, when the data signal Vdata becomes smaller, the strength of light emitted from the OLED becomes smaller because the driving current becomes smaller. Accordingly, the light strength (luminance) of the OLED can be controlled according to the strength of the data signal Vdata.

Each pixel 15 of the pixel unit 14 is driven by the scan signal Vs of the scan driver 11 and the data signal Vdata of the data driver 12. The scan driver 11 and the data driver 12 are driven by the timing controller 10. Accordingly, when a control signal is generated from the timing controller 10, each pixel 15 of the pixel unit 14 can be driven. If a control signal is not generated from the timing controller 10, the pixel unit 14 is not driven. The power supply 13 constantly supplies the power voltage VDD to the pixel unit 14, irrespective of the timing controller 10.

That is, even when a control signal is not generated from the timing controller 10 and thus the pixel unit 14 is not driven, the power voltage VDD is continuously supplied to the pixel unit 14. In this case, each pixel 15 of the pixel unit 14 may or may not emit light. That is, even when the first and second transistors M1 and M2 are turned off, the OLED may emit light due to the power voltage VDD or may not emit light. If the OLED is driven by the power voltage VDD even when the pixel unit 14 is not driven, an undesirable raindrop phenomenon or afterimage may be generated. That is, if some of the pixels 15 in the pixel unit 14 emit light due to the power voltage VDD even when the pixel unit is not driven, a raindrop phenomenon or an after image may be generated.

SUMMARY OF THE INVENTION

Accordingly, the present invention is directed to an apparatus and method for driving an organic light emitting display, which substantially obviates one or more problems due to limitations and disadvantages of the related art.

An advantage of the present invention is to provide an apparatus and method for driving an organic light emitting display, which can prevent a raindrop phenomenon or an afterimage by controlling the supply of a power voltage.

Additional advantages and features of the invention will be set forth in part in the description which follows and in part will become apparent to those having ordinary skill in the art upon examination of the following or may be learned from practice of the invention. The advantages of the invention may be realized and attained by the structure particularly pointed out in the written description and claims hereof as well as the appended drawings.

To achieve these advantages and in accordance with the purpose of the invention, as embodied and broadly described herein, an organic light emitting display includes a pixel unit including a plurality of pixels arranged in a matrix pattern; a power supply for supplying a power voltage to the pixel unit; a power voltage controller for receiving a driving state control signal from a timing controller and controlling a supply of the power voltage based on the driving state control signal.

In another aspect of the present invention, an organic light emitting display includes a pixel unit including a plurality of pixels arranged in a matrix pattern; a power supply for supplying a power voltage to the pixel unit; a timing controller for generating a switch control signal based on a driving state of the pixel unit; and a switch for turning on or off a supply of the power voltage in response to the switch control signal.

In another aspect of the present invention, a method for driving a display device having a display unit that includes a plurality of pixels arranged in a matrix pattern includes determining a driving state of the display unit using a vertical sync signal; and controlling a supply of a power voltage to the display unit based on the determined driving state of the pixel unit.

In yet another aspect of the present invention, a display device includes a display unit for displaying an image, the display unit including a plurality of pixels; a power supply for supplying a power voltage to the display unit; a controller for detecting a driving state of the display unit and generating a switch control signal; and a switch for turning on or off a supply of the power voltage according to the switch control signal.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention.

In the drawings.

DETAILED DESCRIPTION OF THE ILLUSTRATED EMBODIMENTS

Reference will now be made in detail to embodiments of the present invention, examples of which are illustrated in the accompanying drawings. Wherever possible, the same reference numbers will be used throughout the drawings to refer to the same or like parts.

Figure 1:
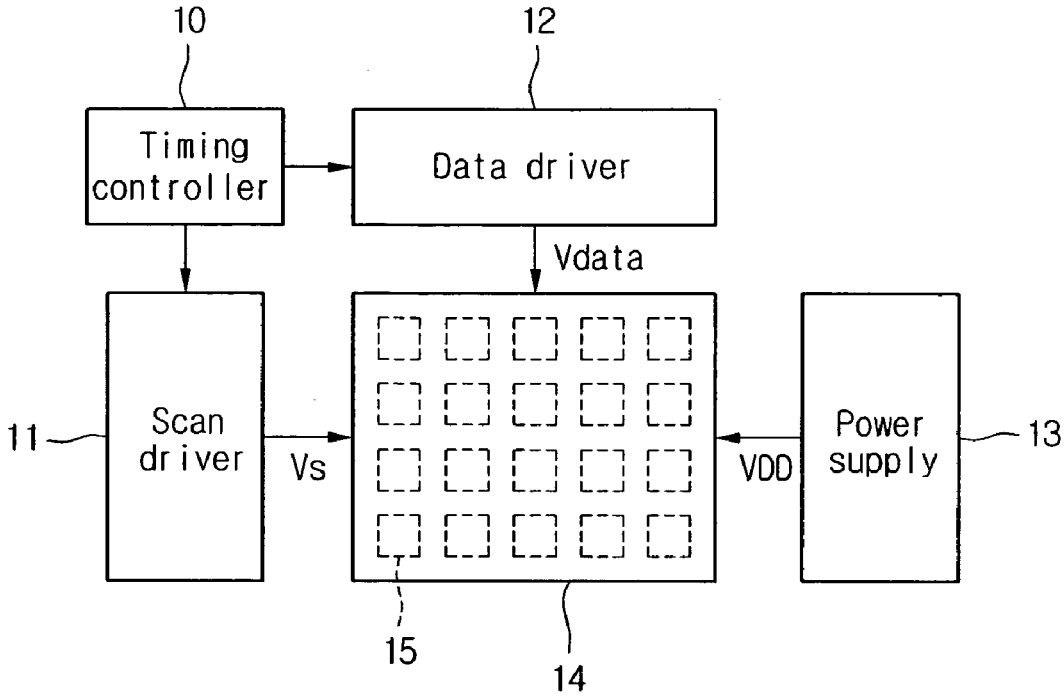
Fig.1 Related Art
FIG. 1 is a block diagram of a related art organic light emitting display.
Figure 2:
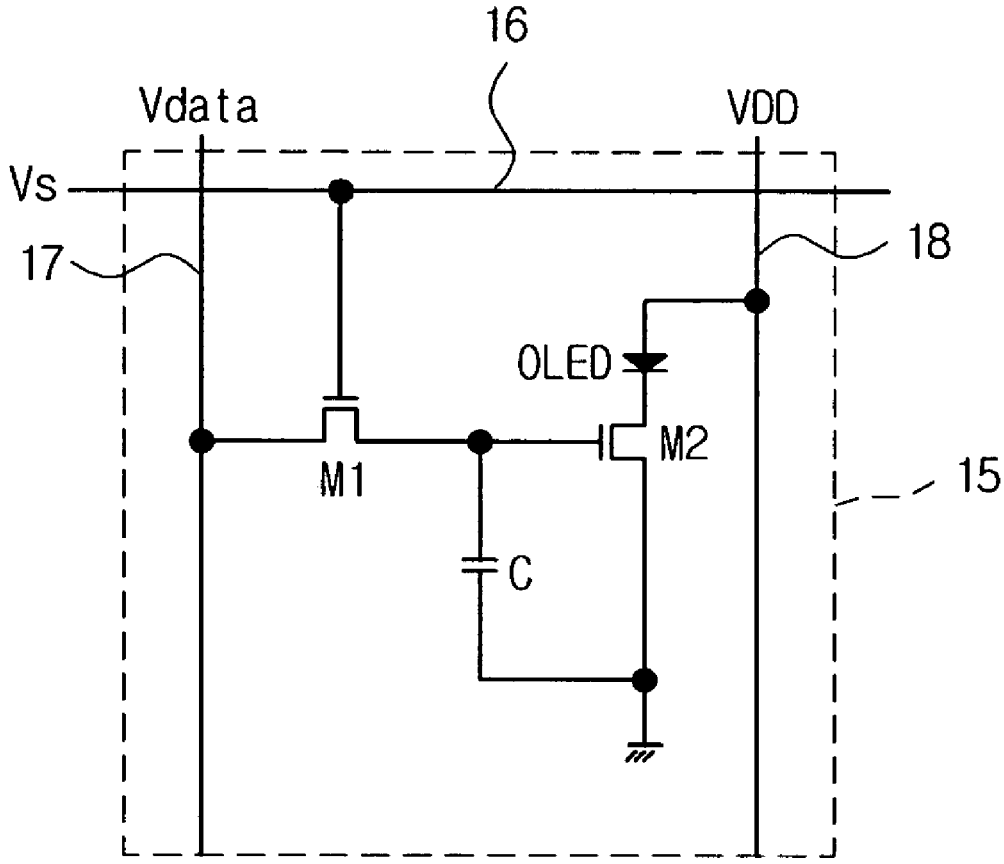
Fig.2 Related Art
FIG. 2 is a circuit diagram of a pixel shown in FIG. 1.
Figure 3:
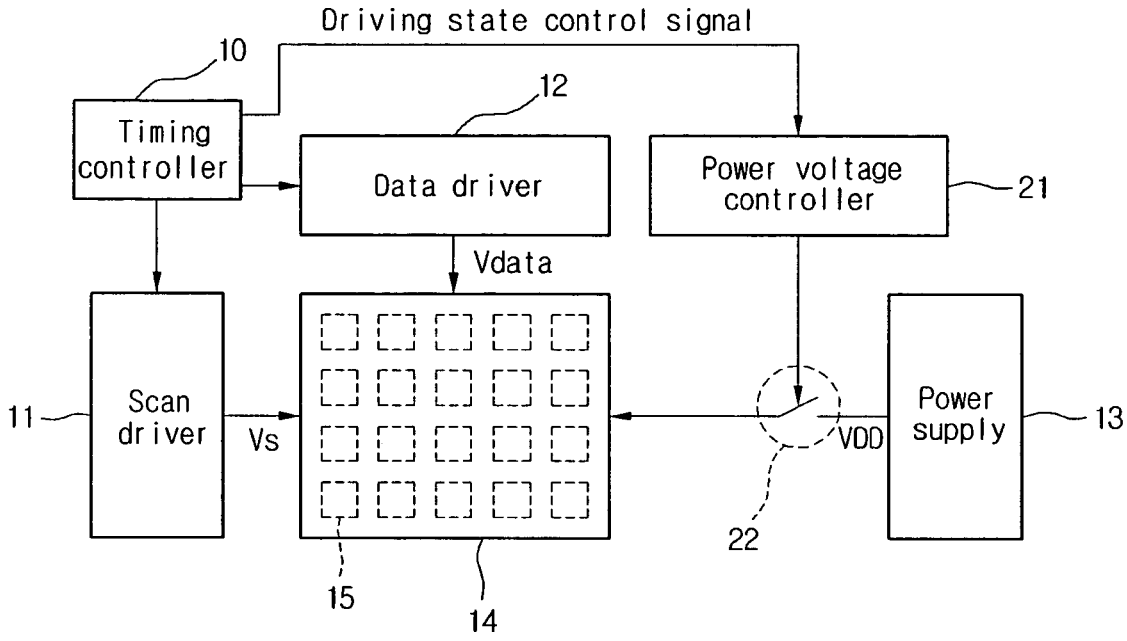
FIG. 3 is a block diagram of an organic light emitting display according to a first embodiment of the present invention.

FIG. 3 is a block diagram of an organic light emitting display according to a first embodiment of the present invention. Referring to FIG. 3, an organic light emitting display (OLED) according to the present invention includes a timing controller 10 for generating control signals, a scan driver 11 for sequentially supplying a scan signal "Vs" in response to a control signal generated from the timing controller 10, a data driver 12 for supplying a data signal "Vdata" in response to a control signal generated from the timing controller 10, a power supply 13 for supplying a power voltage "VDD", and a pixel unit 14 including a plurality of pixels 15 arranged in a matrix pattern and driving OLEDs of the pixels 15 according to the scan signal Vs and the data signal Vdata.

The organic light emitting display further includes a power voltage controller 21 for controlling a supply of the power voltage VDD on the basis of a driving state control signal supplied from the timing controller 10. For example, the power voltage controller controls a supply of the power voltage VDD using a switch 22 for turning on or off the supply of the power voltage VDD.

The timing controller 10 generates control signals for driving the scan driver 11 and the data driver 12 based on a vertical sync signal Vsync and a horizontal sync signal Hsync supplied from the outside. That is, the vertical sync signal Vsync supplied from the outside determines whether or not the pixel unit 14 is being driven. For example, when Vsync periodically has a high level and a low level, the pixel unit 14 is driven. However, when Vsync maintains a constant level during a certain period of time (e.g., more than one frame), the pixel unit 14 is not driven.

The scan driver 11 sequentially supplies a scan signal Vs to the pixel unit 14 in response to a control signal generated from the timing controller 10. The data driver 12 supplies a data signal Vdata to the pixel unit 14 in response to a control signal generated from the timing controller 10. At this time, the power supply 13 constantly supplies the power voltage VDD to the pixel unit 14, and the pixel unit 14 displays images.

Meanwhile, the power voltage controller 21 determines whether or not to supply the power voltage VDD to the pixel unit 14 on the basis of the driving state control signal supplied from the timing controller 10, and controls the supply of the power voltage VDD. For example, when the driving state control signal indicates that the pixel unit 14 is not driven, the power voltage controller 21 stops the supply of the power voltage VDD by controlling the switch 22. On the contrary, when the driving state control signal indicates that the pixel unit 14 is driven, the power voltage controller 21 sustains the supply of the power voltage VDD by controlling the switch 22. The vertical sync signal Vsync may be used as the driving state control signal.

Figure 4:
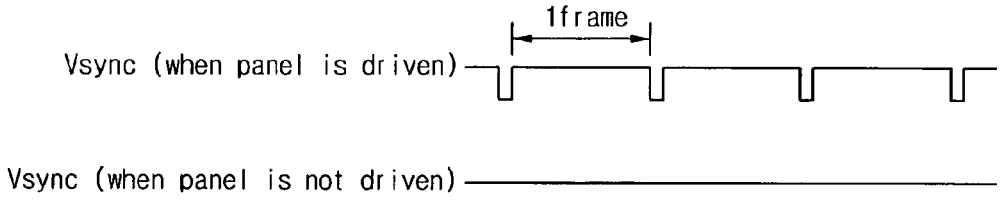
FIG. 4 is a diagram illustrating vertical sync signal waveforms in ON/OFF states in the organic light emitting display shown in FIG. 3.

FIG. 4 is a diagram illustrating vertical sync signal waveforms in ON/OFF states in the organic light emitting display shown in FIG. 3. As shown in FIG. 4, in the case of an ON state, that is, when the pixel unit 14 is driven, the vertical sync signal Vsync has a high level and a low level during a certain period of time (e.g., one frame or several frames). On the contrary, in the case of an OFF state, that is, when the pixel unit 14 is not driven, the vertical sync signal Vsync maintains a constant level during a certain period of time (e.g., more than one frame).

The power voltage controller 21 receives Vsync and determines from the variation of Vsync whether or not the pixel unit 14 is being driven. The power voltage controller 21 may receive a separate reference signal (for example, a high level) for the determination.

Figure 6:
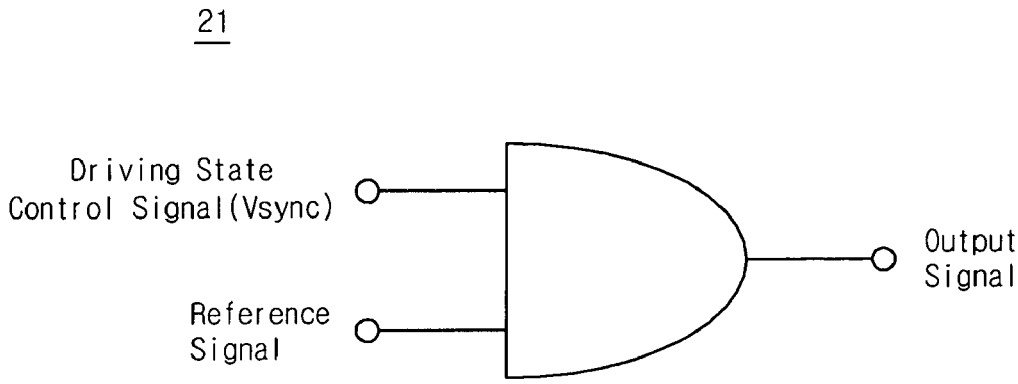
FIG. 6 is a power voltage controller shown in FIG. 3.

As illustrated in FIG. 6, on the basis of the separate reference signal, the power voltage controller 21 determines whether or not the level of Vsync varies during a predetermined period. For example, an AND gate is used for the determination. That is, the AND gate receives Vsync and the reference signal and performs an AND operation on them. For example, when Vsync is normal, a signal "0" is periodically outputted from the AND gate. Accordingly, the power voltage controller 21 can determine from the periodical "0" output signal that the pixel unit 14 is being driven. On the contrary, when Vsync is abnormal, a signal "0" or "1" is constantly outputted from the AND gate. Accordingly, the power voltage controller 21 can determine from the constant "0" or "1" output signal that the pixel unit 14 is not being driven.

The power voltage controller 21 turns on or off the supply of VDD using the switch 22 according to whether or not the pixel unit 14 is driven. That is, when the pixel unit 14 is not being driven, the power voltage controller 21 prevents VDD from being supplied to the pixel unit 14 by turning off the switch 22. On the contrary, when the pixel unit 14 is being driven, the power voltage controller 21 allows VDD to be supplied to the pixel unit 14 by turning on the switch 22.

As described above, in the organic light emitting display according to the first embodiment, the power voltage controller 12 determines the driving state of the pixel unit 14 from Vsync, and turns on or off the supply of VDD by controlling the switch 22 according to a result of the determination.

However, the organic light emitting display may be constructed in such a way that the timing controller 10 directly controls the switch 22 to thereby turn on or off the supply of VDD without using the power voltage controller 21.

Figure 5:
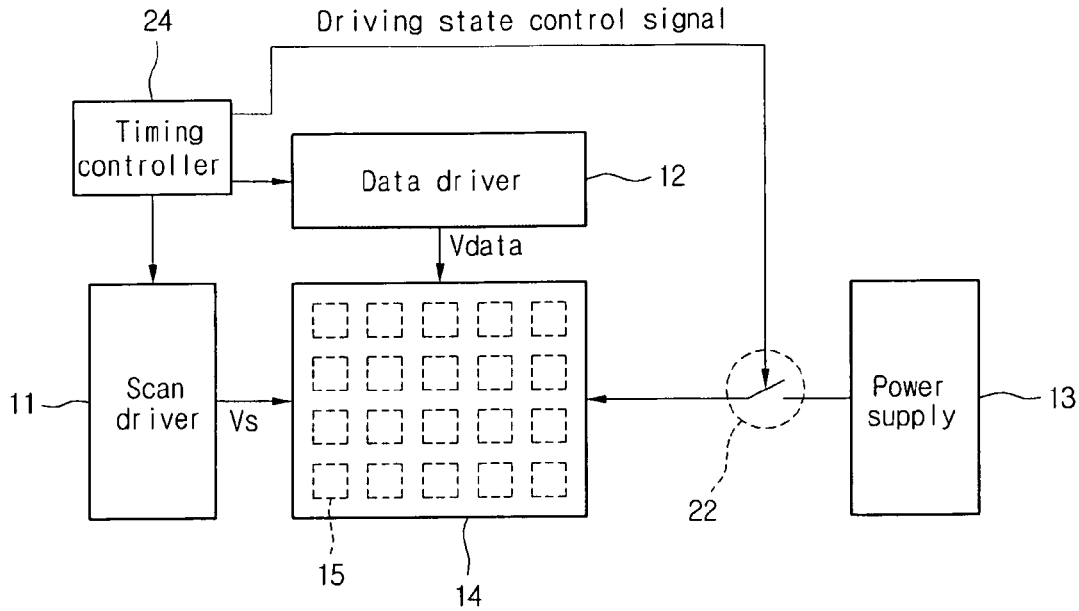
FIG. 5 is a block diagram of an organic light emitting display according to a second embodiment of the present invention.

FIG. 5 is a block diagram of an organic light emitting display according to a second embodiment of the present invention. Referring to FIG. 5, the structure and function of an organic light emitting display according to the second embodiment is basically identical to that of the organic light emitting display according to the first embodiment, with the exception that the organic light emitting display does not include the power voltage controller 21 shown in FIG. 3. That is, in the second embodiment, the timing controller 10 directly controls the switch 22 to thereby turn on or off the supply of VDD. The timing controller 10 determines the driving state of the pixel unit 14 using Vsync supplied from the outside. The determination method is identical to that of the first embodiment and thus a detailed description thereof will be omitted for simplicity.

The timing controller 24 supplies a switch control signal to the switch 22 according to the driving state of the pixel unit 14 that has been determined by the timing controller 24. Accordingly, the switch 22 is turned on or off according to the switch control signal. For example, when the pixel unit 14 is not being driven, the switch 22 is turned off and VDD is not supplied to the pixel unit 14. On the contrary, when the pixel unit 14 is being driven, the switch 22 is turned on and VDD is supplied to the pixel unit 14.

As stated above, an organic light emitting display according to the present invention controls the supply of VDD according to the driving state of the pixel unit, thereby minimizing or preventing a raindrop phenomenon or an after image.

It will be apparent to those skilled in the art that various modifications and variations can be made in the present invention. Thus, it is intended that the present invention covers the modifications and variations of this invention provided they come within the scope of the appended claims and their equivalents.

What is claimed is:

1. An organic light emitting display comprising:

a pixel unit including a plurality of pixels arranged in a matrix pattern;

a power supply for supplying a power voltage to the pixel unit;

a power voltage controller for receiving a driving state control signal from a timing controller and controlling a supply of the power voltage based on the driving state control signal, wherein the driving state control signal represents whether or not the pixel unit is being driven.

2. The display according to claim 1, further comprising a switch for turning on or off the supply of the power voltage under a control of the power voltage controller.

3. The display according to claim 2, wherein the switch is provided between the power supply and the pixel unit.

4. The display according to claim 2, wherein the switch is turned off when the pixel unit is not driven.

5. The display according to claim 2, wherein the switch is turned on when the pixel unit is driven.

6. The display according to claim 2, wherein the power voltage controller determines a driving state of the pixel unit using a vertical sync signal, and the driving state control signal is the vertical sync signal.

7. The display according to claim 6, wherein the power voltage controller includes an AND gate for determining the driving state of the pixel unit.

8. An organic light emitting display comprising:

a pixel unit including a plurality of pixels arranged in a matrix pattern;

a power supply for supplying a power voltage to the pixel unit;

a timing controller for generating a switch control signal based on a driving state control signal; and a switch for turning on or off a supply of the power voltage in response to the switch control signal, wherein the driving state control signal represents whether or not the pixel unit is being driven.

9. The display according to claim 8, wherein the switch is provided between the power supply and the pixel unit.

10. The display according to claim 8, wherein the switch is turned off when the pixel unit is not driven.

11. The display according to claim 8, wherein the switch is turned on when the pixel unit is driven.

12. The display according to claim 8, wherein the timing controller determines the driving state of the pixel unit using a vertical sync signal, and the driving state control signal is the vertical sync signal.

13. The display according to claim 12, wherein the timing controller includes an AND gate for determining the driving state of the pixel unit.

14. A display device comprising:

a display unit for displaying an image, the display unit including a plurality of pixels;

a power supply for supplying a power voltage to the display unit;

a controller for detecting a driving state of the display unit and generating a switch control signal; and a switch for turning on or off a supply of the power voltage according to the switch control signals, wherein the driving state of the display unit is detected from a driving state control signal representing whether or not the display unit is being driven.

15. The display device according to claim 14, wherein the controller determines the driving state of the display unit using a vertical sync signal, and the driving state control signal is the vertical sync signal.

16. The display device according to claim 14, wherein the controller includes an AND gate for determining the driving state of the display unit.

17. The display device according to claim 14, wherein the display device is an organic light emitting display.

* * * * *